United States Patent [19]

Bruner

[11] Patent Number: 4,879,883

[45] Date of Patent: Nov. 14, 1989

[54] OPENABLE RING WITH UNIQUE LOCKING AND RELEASE MEANS

[76] Inventor: Mates A. Bruner, 14 Barbara La., Havertown, Pa. 19083

[21] Appl. No.: 230,285

[22] Filed: Aug. 9, 1988

[51] Int. Cl.[4] ..... A44C 5/00

[52] U.S. Cl. ..... 63/15.7; 63/7; 292/87; 292/90; 292/DIG. 53; 403/290; 403/297; 267/158

[58] Field of Search ..... 63/15.5, 15.7, 15.45, 63/15.65, 5.1, 6, 7, 8; 24/585, 589, 614, 615, 617, 618, 68 J, 71 J, 681, 682, 683, 687, 690; 403/289, 290, 297; 267/158, 163, 47, 260; 292/90, 87, 80, DIG. 53

[56] References Cited

U.S. PATENT DOCUMENTS

| | | | |
|---|---|---|---|
| 1,519,375 | 12/1924 | Heintz | 403/290 X |
| 2,306,317 | 12/1942 | Morrow | 63/7 |
| 4,169,297 | 10/1979 | Weihrauch | 403/290 X |
| 4,693,027 | 9/1987 | Wolff, Sr. et al. | 267/158 X |
| 4,763,490 | 8/1988 | Bruner | 63/15.7 |
| 4,790,148 | 12/1988 | Faini | 63/15.7 |

FOREIGN PATENT DOCUMENTS

| | | | |
|---|---|---|---|
| 994931 | 8/1951 | France | 63/15.7 |
| 2226943 | 11/1974 | France | 63/15.5 |
| 912169 | 12/1962 | United Kingdom | 63/15.7 |

*Primary Examiner*—Laurie K. Cranmer
*Attorney, Agent, or Firm*—Caesar, Rivise, Bernstein, Cohen & Pokotilow, Ltd.

[57] ABSTRACT

A ring to be worn as an article of jewelry about a portion of a body of a person has pivotally mounted, first and second arcuate sections movable between opened and closed positions. A substantially T-shaped recess is provided in the first arcuate section. This recess extends along a portion of the arc of the first arcuate section and includes an outer head portion of a wider transverse dimension than an inner stem portion. The head and stem portions of the recess are joined through upwardly facing, transversely extending supporting surfaces. The recess further has an open free end, and the stem portion of the recess includes an opening along the arcuate inner surface of the first arcuate section for communicating with the interior of the ring. The second arcuate section has an inner surface and a rigid male extending male member projecting therefrom. The male member includes a distal portion having a transverse dimension receivable within the stem portion of the recess and a proximal portion having a substantially T-shaped transverse configuration providing downwardly facing surfaces which overlie the transversely extending supporting surfaces of the recess when the arcuate sections are in a fully closed position. In a preferred embodiment of this invention a latching member is provided for maintaining the male extending member in a position fully inserted within the recess when the arcuate sections are in a fully closed position, and the latching member is operable to both release the locking engagement thereof and to apply a biasing force between the first and second sections in a direction to move the arcuate sections into an opened position. The latching member also forms a part of this invention.

8 Claims, 2 Drawing Sheets

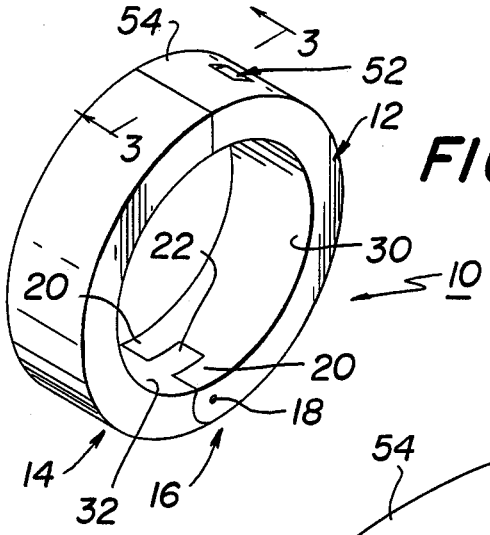
FIG. 1
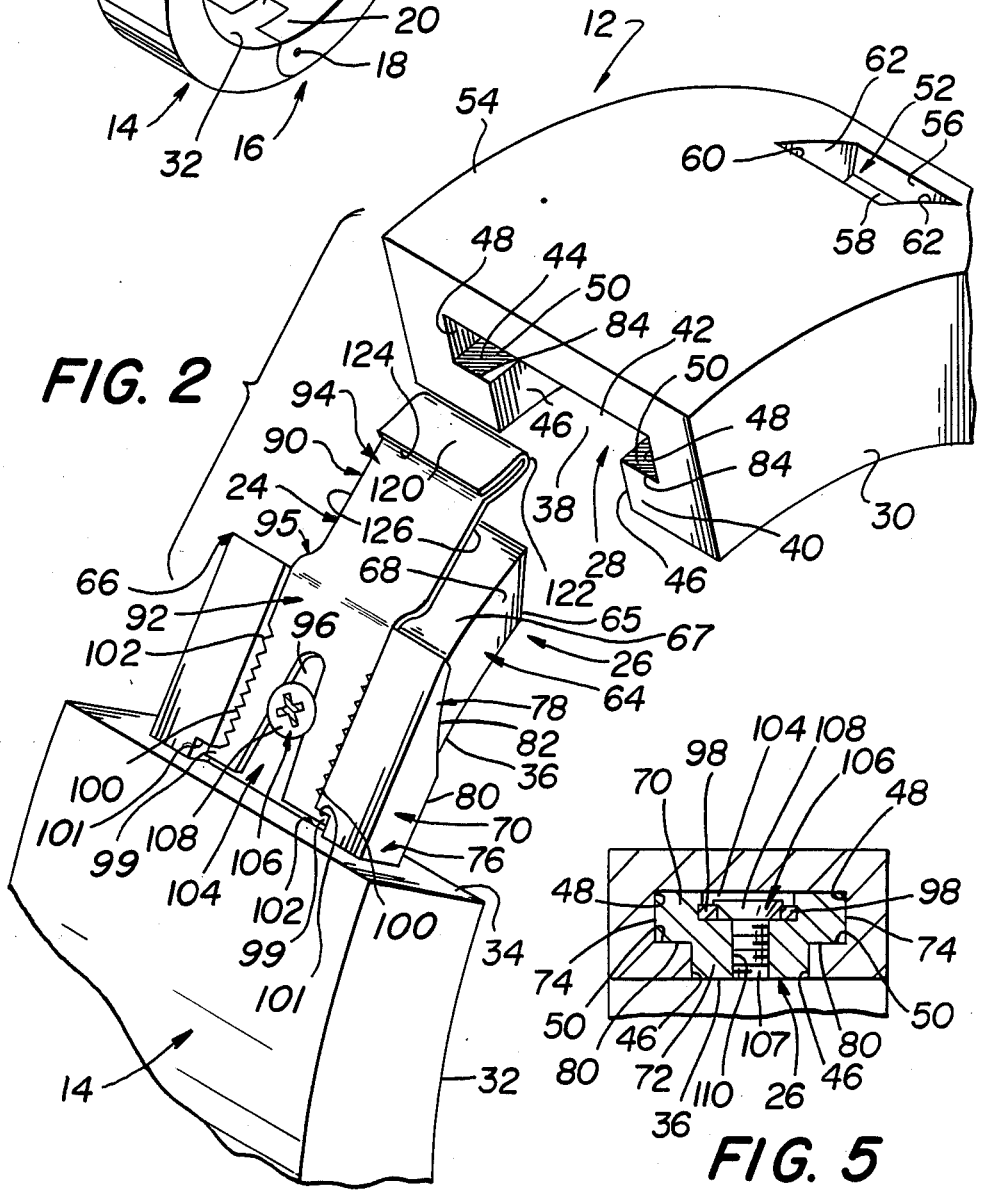
FIG. 2
FIG. 5

OPENABLE RING WITH UNIQUE LOCKING AND RELEASE MEANS

BACKGROUND OF THE INVENTION

This invention relates generally to ring-like objects designed to be worn as jewelry, and more particularly to rings which are enabled to be releasably opened for fitting about a portion of the wearer's body, e.g. finger, which are resistant to accidental opening and which are easily opened, when desired.

Conventional finger rings or other jewelry arranged to be worn about a portion of the body must have a sufficient diameter to slide over the knuckle or other bony protruberance adjacent the point at which the ring is to be worn. Normally, such action does not present any problem since the difference in diameter between the bony protuberance, e.g., knuckle, and the portion on which the ring is worn is sufficient so that a properly fitted ring is comfortable to wear, put on and remove. However, there are numerous individuals who, for a variety of reasons, such as bone fractures, arthritis, etc., have enlarged knuckles or other protuberances which prevent their wearing of conventional jewelry.

The prior art includes adjustable, expandable and openable jewelry rings. For example, some of the prior art discloses rings which are adjustable in size through a specific range. Such rings are limited to a fixed expansion and are hence adapted to permanently remain one particular size. They are also generally constructed so that they can expand only to a limited degree, thus, limiting the size of a knuckle or other protuberance over which they may fit.

The prior art also discloses openable rings having exposed latching members that easily can be opened by a person's finger, to thereby permit repeated opening of the ring. Because these rings have exposed latching members that are designed to be opened by the modest downward force imparted by a person's finger, they inherently lack the desired durability and safety against self-opening.

Examples of prior art adjustable or openable ring-like jewelry are found in Netherlands Patent No. 87,32 (Goldrick), French Patent No. 75 07499 (Algier) and the following U.S. Pat. Nos.: 145,788 (Cottle), 804,137 (Kent), 1,003,696 (Briggs), 1,296,435 (Schmidt), 2,045,282 (Metcalf) 3,204,426 (Armstrong), 3,221,514 (Newman), 3,465,563 (Baker), and 3,736,770 (Kelrick).

Another adjustable construction is disclosed in applicant's copending application Ser. No. 852,095, filed on Apr. 14, 1986, which is a continuation-in-part of application Ser. No. 707,419, now abandoned, filed on Mar. 1, 1985. In this latter construction pivotally interconnected ring sections have a latching mechanism including a male tongue projecting from the free end of one section and a female recess extending into the distal end of the other section. The recess also is open to the inside of the ring structure to permit the male member to move into the recess through the inwardly directed opening thereof. The rear half of the recess is generally rectangular in cross-section, and the forward half of the recess is generally trapezoidal in configuration; having sloping side walls. The male member likewise includes a forward section of a substantially rectangular cross-section and a rearward section of a substantially trapezoidal configuration. As a result of this arrangement the trapezoidal surfaces of the recess and tongue were intended to cooperate for retaining the tongue in proper position within the recess.

Although the construction disclosed in applicant's copending '095 patent is operable, the provision of the trapezoidal surfaces has made it extremely difficult to provide the desired close tolerances to maintain the ring sections in proper position relative to each other during use, while still maintaining ease of assembly and removability. Specifically, in order to properly retain the tongue within the recess when the ring is being worn, it is important that the trapezoidal configuration of the tongue and recess be virtually of the same dimensions, so as to provide a tight fit. Unfortunately, when such a tight fit is provided it is extremely difficult to slideably remove the tongue from the recess during the ring-opening operation.

While some prior art ring structures may be generally suitable for their intended purposes, they still leave much to be desired from the standpoint of utility, ability to provide an aesthetically pleasing appearance, resistance to bending, resistance to accidental opening and/or ease of opening.

SUMMARY OF THE INVENTION

A ring in accordance with this invention is intended to be worn as an article of jewelry about a portion of a body of a person. The ring includes a first, rigid arcuate section having an arcuate inner surface. A substantially T-shaped recess is provided in the first arcuate section and extends along a portion of the arc of said first arcuate section. This T-shaped recess has an upper head portion of a wider transverse dimension than a lower stem portion, and the head and stem portions are joined through an upwardly facing, transversely extending supporting surface. The recess has an open free end, with the stem portion thereof including an opening along said arcuate inner surface for communicating with the interior of the ring. A second, rigid arcuate section is pivotably connected to said first arcuate section for movement relative to said first section between opened and closed positions. The second, rigid arcuate section has an inner surface and a rigid male extending member projecting therefrom. The rigid male extending member includes a distal portion having a transverse dimension receivable within the stem portion of the recess through the open free end of said recess and through the opening along the arcuate inner surface, as the arcuate sections are moved to close the ring. The male extending member further includes a proximal portion having a substantially T-shaped transverse configuration including a downwardly extending surface which overlies the transversely extending supporting surface of the T-shaped recess when the arcuate sections are in a fully closed position. Latching means are provided for maintaining the male extending member in a position fully inserted within the T-shaped recess when the arcuate sections are in a fully closed position.

In accordance with a preferred embodiment of this invention an arcuate guide surface forms a continuous extension of the downwardly extending surface of the proximal portion of the male extending member for guiding the proximal portion into position within the substantially T-shaped recess, with the downwardly extending surface of the proximal portion of the male extending member overlying the upwardly facing, transversely extending supporting surface of the recess.

In accordance with the most preferred embodiment of this invention the latching means is in the form of a spring member having a rear end thereof secured to the male extending member and a forward or distal end thereof normally spring biased into the region of an access aperture that communicates with the head portion of the substantially T-shaped recess, adjacent the rear end of said recess. The spring member has a locking edge normally engaging a surface defining a part of the access aperture, and this locking edge is movable out of locking engagement with said surface by applying an inward pressure thereto, through the access aperture. A surface of the spring member preferably engages an inclined rear wall of the T-shaped recess during inward movement of the spring member to assist in biasing the arcuate sections apart, into a partially opened position.

DESCRIPTION OF THE DRAWING

Other objects and many of the attendant advantages of the instant invention will be readily appreciated as the same becomes better understood by reference to the following detailed description when considered in connection with the accompanying drawing wherein:

FIG. 1 is an isometric view of the ring, in a closed position;

FIG. 2 is an enlarged fragmentary isometric view of the attachment and release section of the ring in opened position to show details of construction;

FIG. 5 is an enlarged sectional view of the ring taken along line 5—5 of FIG. 3;

DETAILED DESCRIPTION OF THE PREFERRED EMBODIMENT

Figure 3:
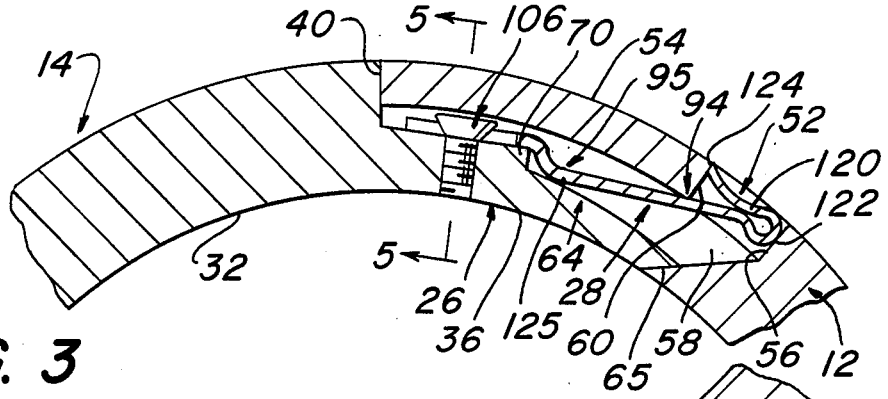
FIG. 3 is an enlarged fragmentary sectional view taken along line 3—3 of FIG. 1, showing details of the attachment and release feature with the ring in a closed position, and the hinge connection between the two ring sections.

Referring now to the various figures of the drawing wherein like reference characters refer to like parts, there is shown as 10 in FIG. 1 a ring constructed in accordance with the subject invention. The ring 10 basically comprises a pair of sections 12 and 14. Each section is formed of a rigid material, such as a precious metal, e.g., gold, and is of generally semi-circular shape. The two sections 12 and 14 are hingedly connected together at 16 by a pin 18. The pin 18 extends through aligned openings in a yoke 20 in one end of section 12 and through an aligned opening in a tang 22 in the corresponding end of section 14. Thus, the two sections 12 and 14 can be pivoted toward and away from each other.

In order to open the ring to enable it to be placed about the finger of a person, without necessitating its being slid over the knuckle of the person, the two sections 12 and 14 are pivoted outward to separate them like shown in FIG. 2. Once the person's finger is disposed between the two open sections, the sections are pivoted toward each other until they are closed and locked together, like shown in FIG. 1. When the two sections are in the position like shown in FIG. 1 they are locked together by a unique latch mechanism 24 in accordance with this invention, and the ring has the appearance of a conventional, non-openable, ring. Thus, the ring of this invention is of particular utility by persons having enlarged knuckles, e.g., arthritic persons, since the ring can be worn without necessitating its being slid over the wearer's knuckle.

The details of the latch mechanism 24 will be described later. Suffice it for now to state that latch mechanism 24 includes mating male and female elements 26 and 28, respectively, and a releasably secureable locking member secured to the male element 26.

As can be seen in FIG. 1 the inner surface 30 of the section 12 and the inner surface 32 of section 14 are both semi-circular and of the same radius so that when the ring is in the closed position, like shown in FIG. 1, the inner surfaces 30 and 32 are aligned with each other to form a continuous, smooth, circular inner surface like any conventional finger ring.

The male element 26 of the latch mechanism 24 is shown most clearly in FIGS. 2–5, and basically comprises a rigid extension or tongue which projects away from the free end 34 of the semi-circular section 12. The extension 26 is arcuate in shape, with its inner surface 36 having the same radius of curvature as the inner surface 32 of section 14, as can be seen best in FIGS. 3 and 4.

As can be seen in FIGS. 2 through 5, the female element 28 basically comprises an elongated recess extending in the end portion of section 12. The recess 28 includes an open mouth 38 extending along the arcuate inner surface 30 of the semi-circular section 12. The recess is also open at the front wall 40 of section 12.

Referring to FIGS. 2 and 5, the recess 28 in accordance with this invention is substantially T-shaped in cross-section; having a lower stem portion 42 and an upper head portion 44. The lower stem portion 42 extends upwardly from the open mouth 38 of said recess and has a transverse dimension defined between spaced, substantially vertical surfaces 46. The transverse dimension of the head portion 44 is greater than the transverse dimension of the stem portion 42, and is defined between spaced-apart vertical surfaces 48. The junction between the stem portion 42 and head portion 44 is provided by upwardly facing shelves or supporting surfaces 50 for supporting the male element 26, as will be described in greater detail hereinafter.

Figure 4:
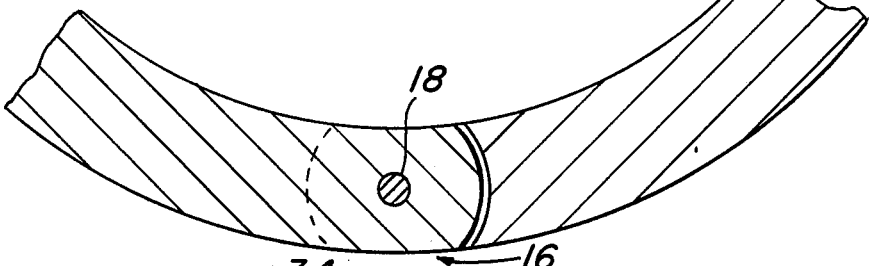
FIG. 4 is an enlarged fragmentary sectional view of the attachment and release section, illustrating the caming arrangement for assisting in opening the ring.
Figure 4:
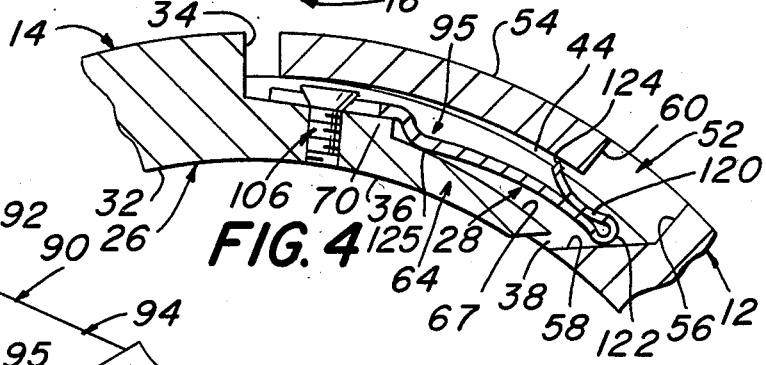

Referring specifically to FIGS. 2–4, an access passage 52, which is substantially rectangular or square in plan view, extends through outer periphery 54 of arcuate section 12, and also communicates with the head portion 44 of the recess 28 adjacent the rear end of said recess. In fact, rear wall 56 of the passage 52 constitutes a continuous extension of inclined rear wall 58 of the recess 28. The access passage 52 is further defined by a front wall 60, which is spaced arcuately from the rear wall 58, and by a pair of transversely spaced-apart sidewalls 62. This access passage 52 is provided to assist in opening the latch mechanism 24, in a manner which will be described in greater detail hereinafter.

Referring specifically in FIGS. 2 and 5, the male element 26, which is in the form of an elongate tongue, includes a distal portion 64 terminating in an outer, inclined surface 65, and a rear or proximal portion 66 joined to the free end 34 of the arcuate section 14. The distal portion 64 of the tongue extends for approximately one-half the arcuate length of said tongue and is substantially rectangular in transverse cross-section. Specifically, the distal portion 64 has a transverse dimension defined between spaced-apart, substantially vertically oriented sidewalls 68 (only one of which is shown in FIG. 2), and this transverse dimension is slightly less than the transverse dimension of the stem portion 42 of the recess 28, as is defined between spacedapart, vertical surfaces 46. The distal portion 64 also includes an upper surface 67 which cooperates with a locking spring element in a manner which will be explained hereinafter.

The rear or proximal portion 66 of the tongue is substantially T-shaped in transverse cross-section; having an upper head section 70 and a lower stem section 72 (FIG. 5). The stem section 72 constitutes a continuous extension of the distal portion 64 of the male element 26.

The upper head section 70 of the male element has a transverse dimension defined between transversely spaced-apart, substantially vertical sidewalls 74, and this transverse dimension is slightly less than the transverse dimension of the upper head portion 44 of recess 28 defined between spaced-apart, vertical surfaces 48.

The upper head section 70 at the proximal portion 66 of the male element 26 includes a rear region 76 and a forward region 78. The rear region 76 joins the lower stem section 72 through an inwardly facing surface 80 (FIGS. 2 and 5). This surface 80 is substantially linear in a transverse direction and is arcuate in the elongate direction in which the male element 26 extends. Specifically, the inwardly facing surface 80 has an arcuate shape which is substantially complimentary to the arcuate shape of the shelves 50 of the recess 28. Therefore, when the ring 10 is in a closed position, as is shown in FIGS. 1 and 5, the inwardly facing surface 80 in the rear region 76 of the head section 70 is supported by the shelves 50 to provide a firm connection between the ring sections 12 and 14 which prevents relative movement between the sections, even when uneven radial or torsional forces are applied to the ring section.

Referring specifically to FIG. 2, the forward region 78 of the head section 70 joins the lower stem section 72 through guide surfaces 82 (only one of which is shown) which are substantial linear in a transverse direction and arcuate in a direction in which the male element 26 extends. These guide surfaces 82 ride along the transversely extending edges 84 at the junction between the front wall 40 of section 12 and the upwardly facing shelves 50 of the recess 28, to thereby guide the male tongue element 26 into the T-shaped recess 28. The arcuate configuration of the guide surfaces 82 is desired since the relative movement between the guide surfaces 82 and the transversely extending edges 84 is in an arcuate path about the fixed pivot pin 18.

In order to realeaseably secure the two ring sections 12 and 14 together when the ring is closed, the latch mechanism 24 includes a locking spring element 90. This spring element locks the two sections 12 and 14 together when the sections are fully closed, like shown in FIG. 1.

Referring to FIGS. 2–4 and 6, the locking spring element 90 includes a rear, forked end 92 for attachment to the male element 28, a forward locking section 94, and a curved transition section 95 between said rear and forward ends to enhance spring tension, as will be discussed in detail hereinafter. The rear end 92 includes a U-shaped passage 96 therein, located intermediate a pair of legs 98. The rear ends of the legs 98 include outwardly or transversely extending locking tabs 99. These tabs engage behind rearwardly facing shoulders 101 provided by a stepped configuration in vertically oriented surfaces 102. These latter surfaces define sidewalls of a recess 104 in the upper surface of the head section 70 of the male element 26. The outer longitudinal edge 100 of each of the legs 98 is serrated in the region located forwardly of the locking tabs 99, and the transverse dimension between the serrated edges 100 is close to the transverse dimension between contiguous regions of the substantially vertically oriented surfaces 102 defining the sidewalls of the recess 104.

Referring specifically to FIGS. 2 and 5, a fastener 106 preferably as in the form of a screw having a threaded stem section 107 and a head 108 having a frusto-conical configuration. A base of the recess 104 in the upper surface of the head section 70 includes a threaded passageway 110 therein for receiving the threaded stem 107 of the fastener 106.

As can be seen best in FIG. 5, when the threaded fastener 106 is threaded into the passageway 110 the conical surface of the head 108 engages transversely spaced-apart inner edges of the legs 98 to both trap the legs 98 between the head 108 and the base 100, and also to force the legs 98 of the fork outwardly to cause the serrations on the outer edges 100 thereof to dig into the sidewalls 102 of the recess 104, and thereby provide a firm connection between the male element 26 and the locking spring element 90. Due to the fact that the spring element 90 is made of a harder material, e.g., spring steel, than the precious metal from which the ring is made, the serrations of the edges 100 are effective to dig into the precious metal of the ring to establish the above-described, firm interconnection between the male element 26 and the spring element 90. However, as a precautionary measure, the locking tabs 99 are provided to retain the spring element 90 in the recess 104, even if the fastener 106 should loosen somewhat during use of the ring.

As can be seen best in FIG. 2, the distal end of forward locking section 94 of the spring element is folded back on itself to form a top wall section 120 located between a fold-line 122 and a rearwardly facing locking edge 124. Preferably the forard locking section 94, including the top wall section 120 thereof, has a transverse dimension defined between transversely spaced-apart side edges 126. The transverse dimension of the locking section 94 is less than the transverse dimension of the lower stem portion 42 of the recess 28, and also is slightly less than the transverse dimension of the access passage 52, defined between the transversely spaced-apart sidewalls 62 thereof. Most preferably the dimension of the top wall section 120 between the fold-line 122 and the rearward locking edge 124 is substantially the same as, and preferably just slightly less than the dimension of the access passage between rear wall 56 and front wall 60.

Referring specifically to FIG. 3, when the ring 10 is in a completely closed position the forward locking section 94 of spring element 90 is normally biased into the region of the access passage 52, with the top wall section 120 thereof substantially filling the passage 52. In this orientation the rearwardly facing locking edge 124 of the top wall section 120 is located to engage the front wall 60 of the passage 52 to thereby prevent the ring from inadvertently opening. Moreover, the top wall section substantially fills the passage 52 to prevent dust from entering the region of the recess 28.

In order to establish the desired spring tension in the spring element 90, the forward locking section 94 is upwardly inclined in a direction from the transition section 95 to the distal end of said locking section. As can be seen best in FIG. 3, the junction 125 between the transition section 95 and the forward locking section 94 acts against the surface 67 as a fulcrum or pivot area for the upwardly inclined locking section 94 to enhance the spring tension or stiffness of the latching mechanism.

When the ring sections 12 and 14 are moved from an opened position, as is illustrated in FIG. 2, to a closed position, as is shown in FIGS. 1 and 3, the distal portion 64 of the tongue initially moves into the T-shaped recess 28 through both the front wall 40 of section 12 and the inwardly facing open mouth 38 of said recess. The provision of the open mouth 38 is extremely important, since it permits the required arcuated movement of the sections 12 and 14 into a completely closed condition, wherein the inwardly facing surface 36 of the tongue 26 forms a continuous extension of the remaining inner periphery of the closed ring, and further wherein the outer inclined surface 65 of the distal portion of the tongue overlies and is supported by inwardly inclined rear wall 58 of the recess 28, as is shown in FIG. 3.

It also should be noted that the top wall section 120 of the forward locking section 94 of the spring element 90, when in locking position, is still located inwardly of the outer periphery 54 of ring section 12. Thus, the likelihood that the spring element 90 will be inadvertently pressed inwardly to release the connection between sections 12 and 14 is remote.

In order to open the ring a pencil or other suitable object is inserted into access passage 52 and pressed downwardly against the top wall section 120 of the locking spring element 90. This inward pressure initially causes the rearwardly facing locking edge 124 of the top wall section 120 to clear the wall 60 of the access passage 52, thereby permitting the ring sections 12 and 14 to be opened. However, in accordance with this invention, opening of the ring sections is assisted by continuously forcing the spring element 90 in an inward direction, to cause the folded edge 122 of the forwarding locking section 94 to ride along the inclined rear wall 58 of recess 28. This latter movement provides a biasing force between the sections 12 and 14 which tends to separate them, as is best shown in FIG. 4. Once the ring sections 12 and 14 have been partially opened it is extremely easy to complete the opening operation by manually gripping one or both of the sections 12 and 14 and moving them about the pivot pin 18.

From the above discussion it should be apparent that the cooperative arrangement of elements provides a locking arrangement between ring sections 12 and 14 which permits the effective transmission of torsional and radial forces between the sections, which provides a reliable interconnection that is not likely to inadvertently open, separate or misalign, and which permits extremely easy and reliable opening of the ring sections when desired.

Figure 7:
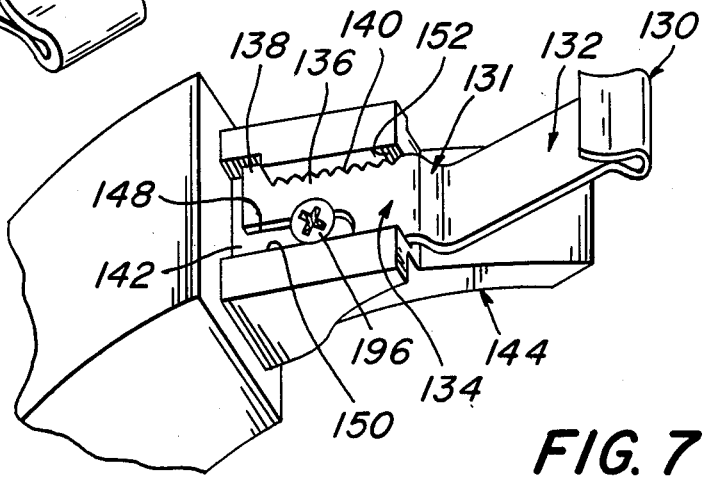
FIG. 7 is an enlarged fragmentary isometric view of a portion of the attachment and release section of the ring, showing a second and preferred configuration of a locking spring arrangement in accordance with this invention.

Referring specifically to FIG. 7, an alternative and actually preferred embodiment of a locking spring element is shown at 130. Specifically the spring element 130 has a forward locking section 132 and curved transition section 131 which, except for being somewhat narrower, are constructed of the same shape and configuration as the forward locking section 94 and the curved transition section 95, respectively, of the spring element 90. Moreover the forward locking section 132 cooperates with an access passage in the same way as the forward locking section 94 cooperates with the access passage 52.

Figure 6:
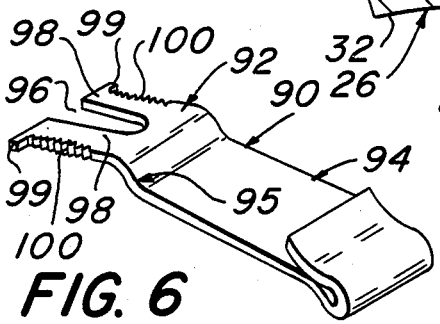
FIG. 6 is an enlarged isometric view of one locking spring configuration in accordance with this invention.

The major distinction between the locking spring element 130 shown in FIG. 7 and the locking spring element 90 shown in FIG. 6 is that the rear locking section 134 of spring element 130 includes only one leg 136. However, the leg 136 has a locking tab 138 and a serrated edge 140 which provide exactly the same functions as the locking tabs 99 and serrated edges 100 in the locking spring element 90. Specifically, the locking spring element 130 is adapted to be secured within a recess 142 of a male element 144 which has a transverse dimension that is smaller than that of recess 104. When the locking spring element 130 is employed with a threaded screw 146 for the purpose of securing the spring element to the male element 144, the fustro-conical surface of the screw head cooperates with the upper inner edge 148 of the single serrated leg 136 and an adjacent edge 150 of the recess 142 to provide the biasing force which causes the serrations of edge 140 to dig into an adjacent side wall 152 of the recess 142. In all other respects a ring employing the spring element 130 shown in FIG. 7 functions in identically the same manner as the ring 10 described herein.

Without further elaboration the foregoing will so fully illustrate my invention that others may, by applying current or future knowledge, readily adopt the same for use under various conditions of service.

What is claimed as the invention is:

1. A ring to be worn as an article of jewelry about a portion of a body of a person, said ring comprising: a first rigid arcuate section having an arcuate inner surface, a substantially T-shaped recess in said first arcuate section extending along a portion of the arc of said first arcuate section and having an outer head portion of a wider transverse dimension than an inner stem portion, said head portion and stem portion being joined through upwardly facing, transversely extending support surfaces forming part of said recess, said recess having an open free end with the inner stem portion of said recess including an opening along said arcuate inner surface for communicating with the interior of the ring, said first arcuate section including an access aperture extending through an outer surface adjacent a rear end of the substantially T-shaped recess and communicating with the outer head portion of said T-shaped recess; a second rigid arcuate section pivotably connected to said first arcuate section and having an inner surface and a rigid male extending member projecting therefrom, said male extending member including a distal portion having a transverse dimension receiveable within the stem portion of the recess through both the open free end of said recess and the opening along said arcuate inner surface of said recess, said male extending member further including a proximal portion having a substantially T-shaped transverse configuration including downwardly extending surfaces overlying the transversely extending support surfaces of the T-shaped recess when said arcuate sections are in a fully closed position, and latching means for maintaining the male extending member in a position fully inserted within said recess when the arcuate sections are in a fully closed position, said latching means including a spring element having a rear end attached to the male extending member and a forward locking section having a locking edge normally disposed within the access aperture when the arcuate sections are in a closed position to thereby maintain said arcuate sections in said closed position, a rear surface of said T-shaped recess being inclined and engageable by a surface of the spring element when the section of said spring element located in the access aperture is biased inwardly out of alignment with the access aperture to thereby provide a force between the arcuate sections in a direction for opening said arcuate sections.

2. The ring of claim 1 wherein arcuate guide surfaces form extensions of the downwardly facing surfaces of the proximal portion of the male extending member and are located distally of said downwardly supporting surfaces for guiding the proximal portion of the male extending member into the substantially T-shaped recess with the downwardly facing surfaces of the proximal portion overlying the upwardly facing, transversely extending support surfaces of the recess.

3. The ring of claim 1 wherein a distal edge of the spring element located within the perimeter of the access aperture engages the inclined rear wall of the substantially T-shaped recess when the spring element is moved in said inward direction.

4. The ring of claim 1 wherein a distal end of the spring element is folded rearwardly over itself to provide a top wall section located within the perimeter of the access aperture when the arcuate sections of the ring are in a closed position, with a folded edge of the top wall section being adjacent one wall of the access aperture and a rearwardly facing locking edge of said top wall section being adjacent an opposed wall of said access aperture.

5. The ring of claim 4 wherein the folded edge of the top wall section engages the inclined rear wall of the substantially T-shaped recess for providing a force between the arcuate sections which moves said arcuate sections apart when the distal end of said spring element is moved in an inward direction.

6. The ring of claim 1 wherein the rear end of the spring element is disposed within a recess of the male extending member and includes at least one serrated edge aligned with a surface of said recess in said male member, and means for biasing said serrated edge into engagement with said surface for assisting in securing the spring element to the male extending member.

7. The ring of claim 6 wherein the rear end of the spring element further includes a locking tab engageable by a surface of said recess for assisting in securing the spring element to the male extending member.

8. The ring of claim 6 wherein the rear end of the spring element includes spaced-apart forks, the outer surfaces of each fork being serrated and disposed in alignment with an adjacent surface of the recess in the male extending member, said liasing means being disposed between the forks and movable for biasing the serrated edges of the forks into engagement with said aligned surfaces of the recess in the male member for aiding in securing the spring element to said male member.

* * * * *